United States Patent [19]

Garrison

[11] 4,446,996

[45] May 8, 1984

[54] MEANS OF SECURING GARMENT CLAMPS TO HANGER

[75] Inventor: Judd F. Garrison, Grand Rapids, Mich.

[73] Assignee: John Thomas Batts, Inc., Zeeland, Mich.

[21] Appl. No.: 299,042

[22] Filed: Sep. 3, 1981

[51] Int. Cl.[3] ..... A47J 51/14

[52] U.S. Cl. ..... 223/96; 211/119.13; 211/124; D6/253

[58] Field of Search ..... 223/93, 96, 90, 91; 24/137 A, 137 R, 138, 3 J; D6/253; 211/119.12, 119.13, 124; 40/11 R, 13

[56] References Cited

U.S. PATENT DOCUMENTS

| | | | |
|---|---|---|---|
| 209,799 | 1/1968 | Stubbs | D6/253 |
| 1,674,043 | 6/1928 | Hoffman | 223/91 |
| 1,683,049 | 9/1928 | Penley | 24/137 A |
| 2,209,697 | 7/1940 | Kislingbury et al. | 24/137 A X |
| 2,246,606 | 6/1941 | Stender | 24/137 A |
| 2,376,584 | 5/1945 | Dessureaw | D6/253 UX |
| 2,499,517 | 3/1950 | Marini | 24/137 A X |
| 3,203,061 | 8/1965 | Thomas | 24/137 A X |
| 3,268,128 | 8/1966 | Hobi | 223/96 |
| 3,691,596 | 9/1972 | Ulansey | 24/137 R X |
| 4,395,799 | 8/1983 | Batts | 223/96 X |

FOREIGN PATENT DOCUMENTS

| | | | |
|---|---|---|---|
| 1158736 | 1/1958 | France | 24/137 A |
| 720827 | 11/1966 | Italy | 24/137 A |
| 7306492 | 11/1974 | Netherlands | 24/137 A |
| 173707 | 3/1935 | Switzerland | 24/137 A |
| 375503 | 4/1964 | Switzerland | 223/96 |
| 398487 | 3/1966 | Switzerland | 24/137 A |

*Primary Examiner*—Robert Mackey

*Attorney, Agent, or Firm*—Price, Heneveld, Huizenga & Cooper

[57] ABSTRACT

An article clamp for a hanger is described which has a molded one-piece body of generally H-shape. A spring on one side of the central web pivots the legs about the web to provide a clamping action. A channel extends laterally across the outer face of one of the legs in general alignment with the web joining the legs. The channel opens through the outer face of the leg with the opening being substantially narrower than the cross-sectional width of the channel. The clamp is mounted on a rod-like support by insertion of the rod through the channel with the rod-like support serving as a rigid fulcrum when the clamp grips an article.

2 Claims, 4 Drawing Figures

MEANS OF SECURING GARMENT CLAMPS TO HANGER

FIELD OF THE INVENTION

This invention relates to garment hangers and, more particularly, to the means by which a garment clamp is secured to the body of a hanger.

BACKGROUND OF THE INVENTION

It has become important to develop simplified and inexpensive hangers, specifically designed for use in the shipment of garments from manufacturer to retailer. The use of hangers for this purpose has been made necessary to reduce labor costs and damage to garments. It has also become increasingly essential because of the long distances many garments are shipped between manufacturer and retailer. This situation has created an increasing necessity to develop hangers of minimal structure, low cost and characterized by positive retention of the garment even under prolonged subjection to vibration and impact, creating forces which tend to cause the garment to be released from the hanger. Despite the more demanding performance requirements, it is important to the hanger that its profile and its weight be kept to a minimum to reduce its contribution to shipping costs. Particularly is this true where the shipping is over long distances. With the development of hangers having arm portions of metallic rod, the need for a garment clamp capable of being mounted on the rod without utilizing a complicated structure became a matter of serious concern. Such a hanger is disclosed in co-pending application, Ser. No. 292,669, filed Aug. 13, 1981, now abandoned, entitled "Pant and Skirt Hanger", having a common assignee with this application. While that application discloses a particularly simple and light weight hanger structure, it does not provide a solution to mounting spring biased garment clamps on the rod structure.

BRIEF DESCRIPTION OF THE INVENTION

This invention provides a garment clamp of the type having a pair of sides joined intermediate their ends by an integral, flexible web with the sides being spring biased to pivot around the web into garment clamping position. The invention provides a seat to secure the clamp to the rod with the loading applied to the clamp when the jaws are held in open position by the presence of a clamped garment increasing the grip exerted upon the rod by the clamp. Thus, the stability of the clamp on the hanger body is increased as the load imposed upon the garment hanger is increased.

DESCRIPTION OF THE PREFERRED EMBODIMENT

Figure 1:
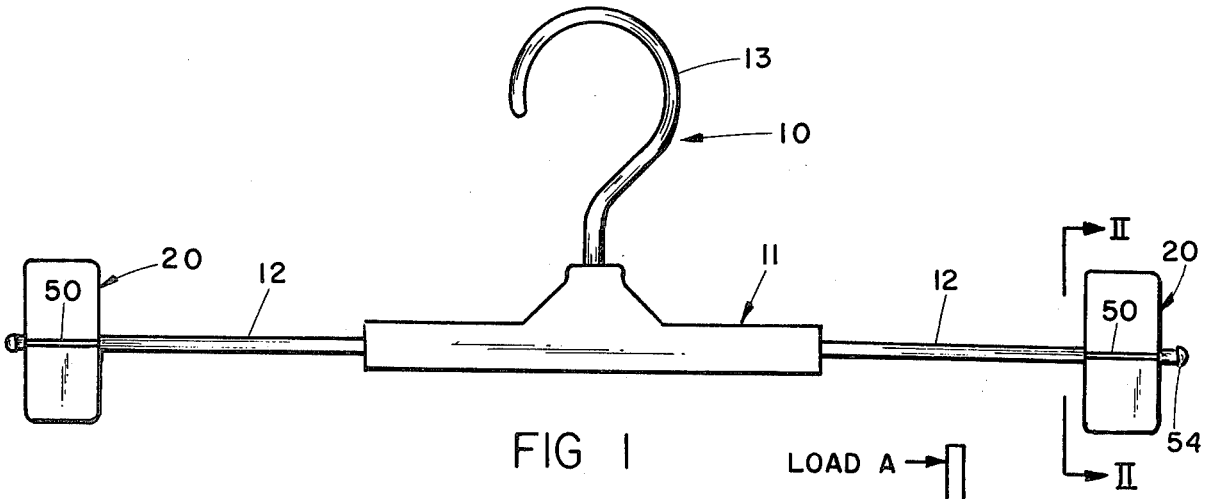
FIG. 1 is a rear, elevation view of a hanger equipped with this invention.

The basic structure of the clamp is the same as that described in co-pending patent application, Ser. No. 277,167, filed June 25, 1981, entitled "Pant Hanger With Internal Spring" now U.S. Pat. No. 4,395,799 granted Aug. 2, 1983, having a common assignee with this application.

The hanger has a body 10 including a molded central section 11, a pair of outwardly extending arms 12 and a supporting hook 13. The arms 12 are rod-like, preferably being cut from steel rod or 10 gauge (0.135 inch diameter) steel wire, plated or coated to protect it against corrosion which could discolor a garment. The arms 12 may be portions of a single length of material which extends through the central section or they may be separate sections which are inserted into the central section from opposite ends. All of the above structure is part of the invention described in the above identified U.S. Pat. No. 4,395,799.

The garments are secured by clamps 20 mounted at or adjacent the ends of the arms 12. Each clamp consists of a molded plastic body having a pair of elongated leg portions 22 and **22*a* joined intermediate their ends by a bar or web 23. The web 23 is of substantial length and preferably is located somewhat closer to the upper end of the leg portions than to the lower end of the leg portions. The web 23 is tapered in vertical cross section from each of the legs 22 and 22*a* and, at its center, has a relatively thin section 25 which flexes and functions as a hinge or fulcrum about which the leg 22** can be pivoted. As initially molded, the body has the general shape of the letter H, the legs of which are substantially spaced apart. The clamp is injection molded from a suitable plastic material having good fatigue strength, resistance to creep and, in thin sections, at least limited flexibility. Suitable resins for its manufacture include polypropylene, nylon, polycarbonate and polyacetal.

The web 23 divides the interior of the clamp into an upper or handle pocket 30 and a lower article receiving or clamping pocket 31. The portions 32 and **32*a* of the legs 22 and 22*a* defining the sides of the pocket 30 form the handles of the clamp and the portions 34 and 34*a* of the legs defining the sides of the garment pocket 31 form the gripping jaws of the clamp. The lower portions of the inside faces of the gripping jaws are equipped with teeth 35 and 35*a* for securing articles inserted into the pocket 31** while the clamp is held open.

Figure 2:
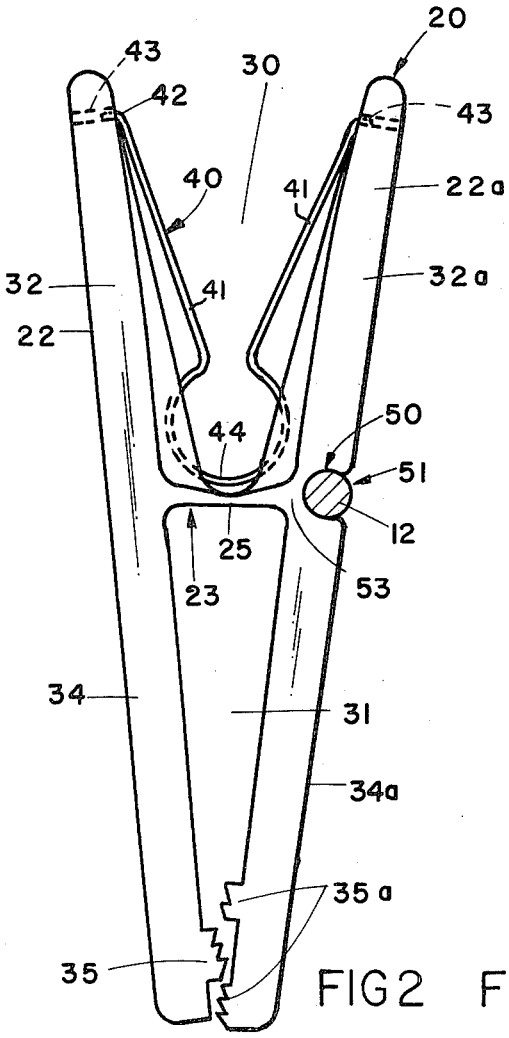
FIG. 2 is an enlarged, sectional view taken along the plane II—II of FIG. 1.
Figure 3:
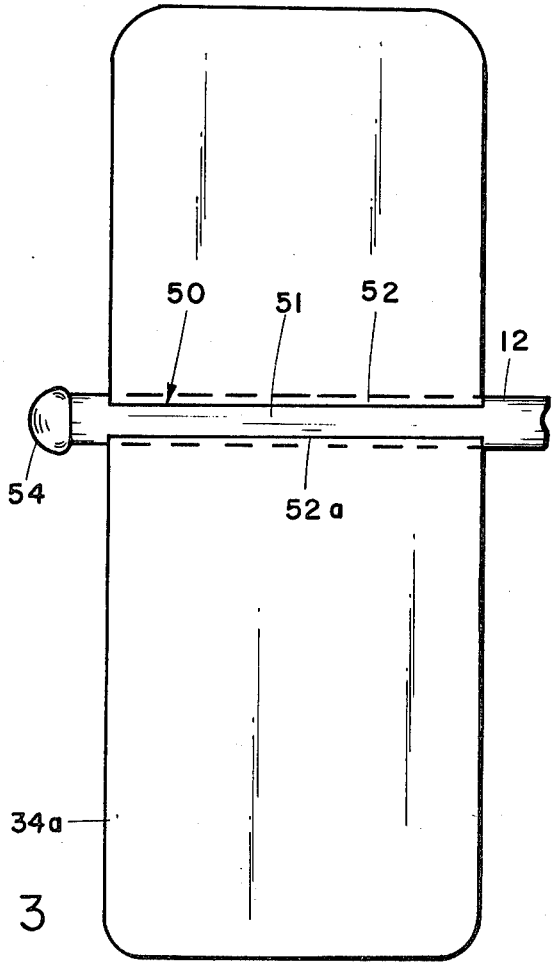
FIG. 3 is an enlarged, rear view of the clamp structure illustrated in FIG. 2.

Seated within the handle pocket 30 is a spring 40. The spring is generally V-shaped having a pair of divergent arms 41, the free ends of which are flanged outwardly to form anchors. The anchors 42 are seated in slots 43 in the ends of the handles (FIG. 2). At the convergent ends of the arms, the spring is formed into a generally circular head 44. The arms of the spring, at the time of installation, are partially pressed together to load the spring and provide a closing bias to the clamp. Because of the bias of the spring, to separate the clamping jaws, it is necessary to press the handles 32 and **32*a* together, thus, causing the legs to pivot about the hinge web 25**.

To secure the clamp to the hanger body 10, the rear leg **22*a* is provided with a channel 50. The channel is basically aligned with the web 23 and extends from one edge of the leg to the other. The channel 50 is circular in cross section and has a portion of one face opening through the rear surface of the leg forming a slot 51. The diameter of the channel 50 is such that it forms a snug fit with the arm 12 of the hanger body. The width of the slot 51 is significantly narrower than the diameter of the channel. Thus, a pair of lips 52 and 52*a* partially close the opening in the wall of the channel to effectively prevent the arm of the hanger from being released through it. The wall thickness of the leg 22***a* is such that a substantial portion of the wall thickness remains beneath the base of the channel and the base of the web 23. This forms a structural bridge 53 in the area of the channel 50. This is important to maintain integrity of the clamp structure.

To mount the clamp on the hanger body, the end of the rod is pushed through the channel 50. A firm frictional fit is formed between the arm and the walls of the channel. In fact, the arm may force a slight spreading of the walls of the channel. After this has been done, to prevent the clamp from being unintentionally or inadvertently disassembled from the rod, the end of the rod is headed at 54.

Figure 4:
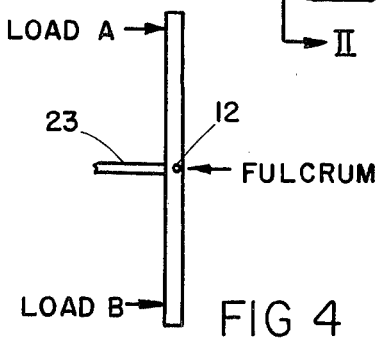
FIG. 4 is a schematic, force diagram illustrating the functional characteristics of the clamp attachment.

When the hanger is to be used, the clamps 20 are opened to receive a garment. This is done by pressing the handle portions 32 and 32*a* toward each other, compressing the spring 40. As this occurs, the web 25 is flexed, permitting the leg 22 to rotate about the center of the web as a fulcrum. During this manipulation of the clamp, only a minor load is placed on the bridge portion 53 of the leg 22*a* inasmuch as no load is exerted by the clamp portions 34 and 34*a* since no resistance to movement is imposed on them. At this point, a garment is inserted between the jaws of the clamp. When the handles are released, the force generated by the spring 40 produces a bending movement about the rod in the pocket 50 which then acts as an incompressible fulcrum. This is graphically illustrated in FIG. 4 wherein the Load A represents the force exerted by the spring and Load B represents the resistance of the garments to the closing movement of the jaws. Under these conditions, because of the fact the channel 50 represents a reduction in the total cross section of the leg and also its location at the web or hinge 23, the rod becomes a fulcrum about which all or substantially all of the bending or flexing of the leg 22*a* occurs. This results in the walls of the channel 50 clamping the rod with increased force. The greater the Loads A and B acting about the fulcrum, the tighter the clamping action and thus the more firmly the clamp assembly is secured to the rod. It will be recognized that this arrangement places the bridge 53 in tension, a type of loading which the plastic materials from which the body of the clamp is molded are particularly adapted to sustain and resist. The leg 22*a* will be prevented from bending outwardly because the presence of the rod in the channel provides positive support resisting compression loads.

It will be seen from the preceding description that this invention provides not only a simple and effective means of attachment of the clamp to the rod structure of the hanger but also provides one having the benefit of clamping the rod with increasing force as the thickness and, therefore, normally the weight of the garments increases. Further, because of the location of the channel and the design of the clamp body, manipulating the clamp to open it does not impose adverse bending loads at the channel since once the clamping pressure of the jaws is released, the force couple acting around the channel is also relieved. The jaws, at this point, offer no particular resistance since all resistance to pivoting of the legs is concentrated in the spring which acts between the ends of the handle portions beneath the operator's hand. The invention also eliminates the necessity for left and right hand parts since the identical clamp can be used at both ends of the hanger body.

It will be seen from the preceding description that a simple and effective means of mounting the clamps to the hanger body is provided. This means is both inexpensive to manufacture and simple to install. It will be recognized that the invention is not necessarily limited to garment hangers nor is it limited to a hanger having the specific body construction illustrated.

Having described a preferred embodiment of this invention, it will be understood that modifications can be made without departing from the principles of the invention. Such modifications are to be considered as included within the hereinafter appended claims unless these claims, by their language expressly state otherwise.

I claim:

1. A garment hanger comprising a body consisting of a single cylindrical rod extending lengthwise of said hanger and a clamp depending therefrom, said claim being H-shaped and having a pair of legs and integral hinge means intermediate the ends of said legs joining said legs for pivotal movement with respect to each other; spring means acting at one end of said legs for forcing the other ends thereof together as clamping jaws, said clamp characterized in that a channel extends laterally of one of said legs; said channel having an opening extending through the outer surface of said one of said legs oppositely from and aligned with said hinge means; said channel being of a size and shape to snugly receive said single cylindrical rod therethrough and yet provide for relative movement lengthwise and in radial orientation between said clamp and said rod for adjusting the position of said clamp relative to said rod; said opening through said surface being more narrow than said channel for preventing said rod from passing therethrough; said channel being of a size and shape that the cross section of said one of said legs is substantially decreased and the flexibility of said one of said legs adjacent said channel is substantially increased, said rod being of a non-compressible material and providing support to said one of said legs against bending about said channel when the jaw end of said one of said legs is seated against a garment under the bias of said spring whereby the pressure with which said walls of said channel grip said rod is substantially increased due to the flexibility of said one of said legs adjacent said channel and the pressure of said spring against a garment clamped between said legs, the increase in the pressure with which said walls of said channel grip said rod thereby stabilizing the position of said clamp relative to said rod when a garment is placed on said hanger.

2. The garment hanger as described in claim 1 further characterized in that said channel is of the same cross-sectional shape and of a size smaller than that of said rod whereby the width of said opening through said surface increases as said rod is forced through said channel.

* * * * *